United States Patent [19]

Tsumura et al.

[11] Patent Number: 4,590,489

[45] Date of Patent: May 20, 1986

[54] THERMAL HEAD

[75] Inventors: Makoto Tsumura; Ryozo Takeuchi, both of Hitachi, Japan

[73] Assignee: Hitachi, Ltd., Tokyo, Japan

[21] Appl. No.: 706,953

[22] Filed: Feb. 28, 1985

[30] Foreign Application Priority Data

Mar. 2, 1984 [JP] Japan ..... 59-40871

[51] Int. Cl.[4] ..... B41J 3/20

[52] U.S. Cl. ..... 346/76 PH; 338/317; 219/543

[58] Field of Search ..... 346/76 PH, 76 R, 139 C; 219/216 PH, 543; 400/120; 338/204, 217, 333, 317; 250/316.1, 317.1, 318

[56] References Cited

U.S. PATENT DOCUMENTS 4,413,170 11/1983 Val et al. ..... 346/76 PH

FOREIGN PATENT DOCUMENTS 161947 12/1979 Japan .

0212970 12/1983 Japan ..... 346/76 PH

*Primary Examiner*—E. A. Goldberg

*Assistant Examiner*—A. Evans

*Attorney, Agent, or Firm*—Antonelli, Terry & Wands

[57] ABSTRACT

A thermal head of the invention has heating resistors each formed between opposite electrodes of a plurality of pairs of opposite electrodes on an insulating substrate. Each of the heating resistors is formed of a plurality of rectangular parallelepiped resistive elements which are electrically connected in series and supplied with different applied energy per unit surface area at the time of flowing a unit current in the heating resistor. These resistive elements are so arranged as to be the more distant from the resistive element of which the applied energy per unit surface area at the time of flowing a unit current in the heating resistor is the maximum, the less the applied energy per unit surface area at the time of flowing a unit current in the heating resistor.

11 Claims, 26 Drawing Figures

THERMAL HEAD

BACKGROUND OF THE INVENTION

This invention relates to a thermal head and particularly to a thermal head capable of printing multigradational tones.

FIG. 1 shows the structure of a one-dot element of a conventional black-and-white binary thermal head wherein FIG. 1*a* is a plan view thereof, FIG. 1*b* is a cross-sectional diagram taken along line A—A in FIG. 1*a*, and FIG. 1*c* is a graph of the applied energy vs. printed dot area characteristic of the heating resistor. As illustrated in FIG. 1*b*, on an insulating substrate 3 made of ceramic, glass or the like, are formed in turn a resistive layer 2 which is made of a semiconductor alloy such as CrSi (chromium-silicon) and has a substantially constant thickness, and a pair of opposite electrodes 1,1' made of a conductive material such as aluminum or chromium. The resistor of the resistive layer 2 lying between the electrodes 1,1' generates heat when supplied with electric power through the electrodes 1,1', and thus it is called a heating resistor 2.

For printing with a thermal head, there are widely used the thermal type which employs thermal paper and the thermal transfer type in which the thermal head is pressed against a film of which the rear surface is coated with ink and thereby transfers an image to a sheet of ordinary paper disposed under the film. The heating resistor 2 with a constant width and thickness as shown in FIG. 1 generates heat uniformly over its surface. FIG. 1*c* shows the printing characteristic of the heating resistor 2 of such structure. The abscissa indicates the energy relative to the energy necessary for printing one dot of substantially the same area as the surface area of the heating resistor 2 which energy is taken as unity for comparison, and the ordinate indicates the dot area relative to the surface area of the heating resistor 2 which surface area is taken as unity for comparison. From curve 25 in FIG. 1*c* it will be seen that the heating resistor does not start to print until the applied energy P increases and exceeds a constant amount of energy Est. This energy Est is called the printing start energy. The printing start energy Est is dependent on physical constants such as the shape, size, thermal capacity, thermal conductivity and melting points of the heating resistor, substrate and protective film made of ceramic and glass, thermal paper and ink film, ambient temperature, and so on. Particularly this printing start energy Est is greatly dependent on the size of the heating resistor and the recording type. Therefore, it is possible to estimate the printing start energy Est from the selected recording type, and the physical constants of the thermal paper or ink film.

The printing around the printing start energy Est is very unstable because the printed dot area S is changed by the condition in which the thermal head contacts the recording paper, and by the irregularity of the surface of the recording paper, lack of uniformity in the ingredients mixed in the ink and so on. Therefore, an unstable region occurs as shown by the hatched area.

In the heating resistor 2 of the uniformly heat-generating structure shown in FIGS. 1*a* and 1*b*, the unstable condition occurs over the whole resistor and thus it is not possible to stably print dots of an intermediate-level area. For this reason, this heating resistor is not suitable for the conventional halftone printing method of printing smaller dot areas than the surface area of the heating resistor 2.

Moreover, in this heating resistor 2, when the applied energy is increased to exceed the energy E 1.0 at which the average dot area substantially equals the surface area of the heating resistor 2 (i.e., $S=1$), almost no unstable region occurs, or the printing condition enters into the stable printing region, in which stable printing is possible. In the uniformly heating resistor 2 shown in FIGS. 1*a* and 1*b*, however, the dot area is not so greatly changed in the stable printing region ($S \geqq 1$) and thus no multigradation can be achieved.

FIG. 2 shows the structure of the heating resistor 4 of another conventional thermal head capable of halftone wherein FIG. 2*a* is a plan view thereof, and FIG. 2*b* is a cross-sectional diagram taken along line B—B in FIG. 2*a*. The thermal head of this type was disclosed in Japanese Patent Laid-open No. 161947/1979.

The structure of a plurality of thermal head having the heating resistors 4 shown in FIG. 2 is substantially the same as that of a plurality of conventional binary head having the heating resistors 2 shown in FIG. 1, but the shape of its heating resistor 4 is different from that of the heating resistor 2. The resistor 4 has a constant thickness as shown in FIG. 2*b*, but its width continuously varies to be smallest at the center and to be the larger at places nearer to either of the electrodes as shown in FIG. 2*a*. The heating resistor 4 of this structure has a higher current density at the center and thus generates more heat at the center than at the periphery. Therefore, when little energy is applied to the resistor 4, only the center portion of the resistor 4 prints a smaller dot. Moreover, as the applied energy increases, the peripheral portion of the resistor 4 becomes able to print and hence the printed dot area increases. Thus, a halftone picture can be reproduced by controlling the amount of energy to be applied to this head on the basis of gradational data of the picture.

Since the sensitivity of a human's eye to a halftone picture generally becomes high in a low-optical-density range, it is most important to consider the halftone printing ability of the thermal head in the low-optical-density range. In other words, if thermal head meets the requirements that the minimum printed dot area is small, and that the printed dot area is stable with respect to the applied energy, the thermal head can be said to be suitable for printing the halftone. However, it is difficult to control the heating resistor 4 of the thermal head as shown in FIG. 2*a* for halftone printing for the following reasons.

FIG. 3 shows the printing characteristic of the conventional heating resistor shown in FIG. 2 for halftone printing. FIG. 3*a* is a plan view of a half of the heating resistor 4. The half of the resistor 4 as illustrated is equally partitioned along line B—B in FIG. 2*a*, into 100 parts for the purpose of showing the characteristics of the thermal head. FIG. 3*b* is a graph of the printing characteristic of each of the divided parts of the resistor 4, and FIG. 3*c* is a graph of measured dot areas and standard deviation values showing the stability of the dot area with respect to the applied energy.

If the 100 divided parts of the half of resistor 4 are represented by $R_1$, $R_2$, $R_3 \ldots R_{99}$ and $R_{100}$ in the order of width as shown in FIG. 3*a*, the printing characteristics of $R_1$, $R_2 \ldots R_{99}$ and $R_{100}$ are respectively given by $S_1$, $S_2$, $S_3 \ldots S_{99}$ and $S_{100}$ as shown in FIG. 3*b*. Each of many divided parts of the resistor has an unstable region as shown by the hatched area in FIG. 3*b* because it almost uniformly generates heat. In addition, as shown by the characteristics $S_1$, $S_2$, $S_3$ the unstable regions of the adjacent printing characteristics are overlapped, and thus the unstable region always exists until the applied energy P exceeds 1.0 where all the resistors $R_1$, $R_2$ . . . $R_{100}$ reach their stable regions. Moreover, the printed dot area greatly scatters around the average dot area S when most resistor parts are in their unstable regions at low applied energy, or when the gradation printing is made at a low-optical-density.

FIG. 3*c* shows the dot area and standard deviation for the stability of dot area with respect to the applied energy. The characteristic curves in FIG. 3*c* were determined by the experiment on the conventional halftone thermal head element shown in FIG. 2. The abscissa indicates the energy relative to the energy necessary for printing substantially the same area as the surface area of the heating resistor 4 which is "1", the left ordinate shows the printed dot area relative to the surface area of the heating resistor 4, and the right ordinate indicates the standard deviation normalized by dividing by the dot area S (hereinafter, simply called the standard deviation). The greater the standard deviation, the more unstable the printing characteristic, and hence the lower the halftone printing ability. An experiment revealed that the halftone printing ability was greatly reduced when the standard deviation of the dot area exceeds 1. The solid curve, 11 in FIG. 3*c* indicates the dot area with respect to the applied energy and the broken line, 12 therein shows the standard deviation of the dot area. From FIG. 3*c*, it will be seen that in the conventional halftone thermal head, the printing resistor 4 has a standard deviation higher than 1 and hence low halftone ability when it prints a dot area smaller than the surface area of the heating resistor 4. The reason for this will be described with reference to FIG. 4.

FIG. 4 shows the state in which proper electric energy is applied to the heating resistor 4 of the conventional halftone thermal head. The center portion, 13 of the heating resistor 4 is supplied with great energy per unit area and thus can print positively. The portions 14,14' adjacent to the center 13 are supplied with insufficient energy and hence print unstably. The paired portions 15,15' adjacent to the electrodes 1,1' are supplied with little energy and hence cannot print.

Thus, when the heating resistor 4 of this halftone thermal head prints a dot of an area smaller than the surface area of the heating resistor 4, the unstable printing regions of the portions 14,14' are always involved in the printing, and hence make the printing characteristics unstable. Particularly, the unstable printing regions degrade the printing quality of the low-optical-density gradation which needs to stably print very small dots.

SUMMARY OF THE INVENTION

Accordingly, it is an object of the invention to provide a thermal head capable of printing a high-quality picture particularly in a low-optical-density region and of multi-gradation halftone printing.

According to this invention, there is provided a thermal head of which the heating resistor is formed by a series of a plurality of resistive elements to each of which different energy per unit surface area is applied when a unit current is flowed, so that the stable printing starting energy of the resistive elements are discrete at different applied energy, values respectively. Therefore, the unstable regions of the printing characteristics can be greatly reduced, particularly the printing quality at low density can be improved and the halftone of multigradation can be printed.

The above defects, features and advantages of the present invention will be apparent from the following description taken in conjunction with the accompanying drawings.

DESCRIPTION OF THE PREFERRED EMBODIMENTS

Figure 1A:
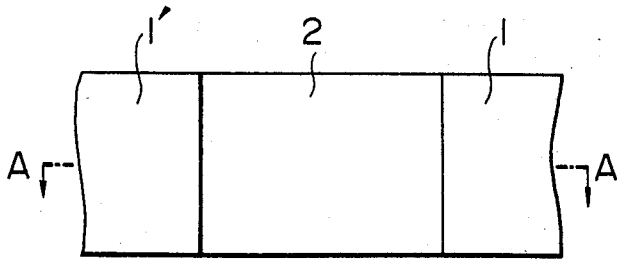
FIG. 1a PRIOR ART
FIGS. 1*a*, 1*b* and 1*c* are a plan view of the heating resistor of a conventional binary thermal head, a cross-sectional view taken along line A—A in FIG. 1*a*, and a graph of the printing characteristics of the resistor, respectively.
Figure 1B:
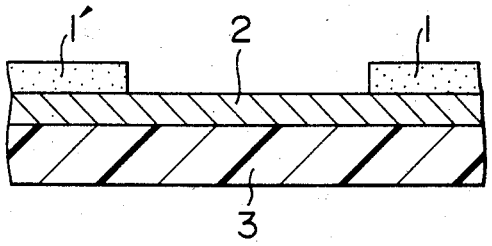
FIG. 1b PRIOR ART
Figure 1C:
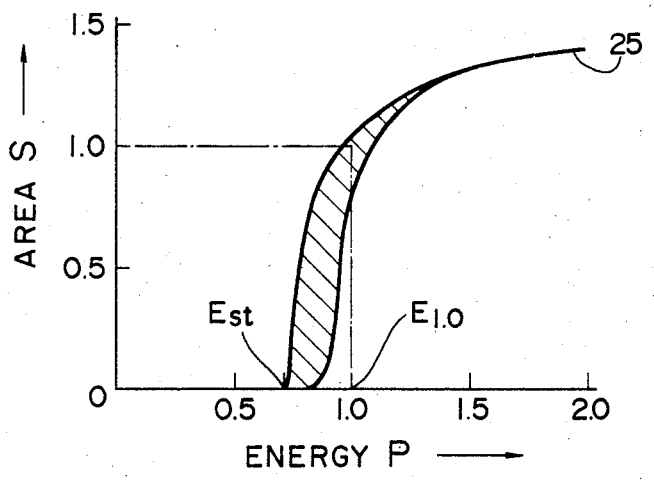
FIG. 1c PRIOR ART
Figure 2A:
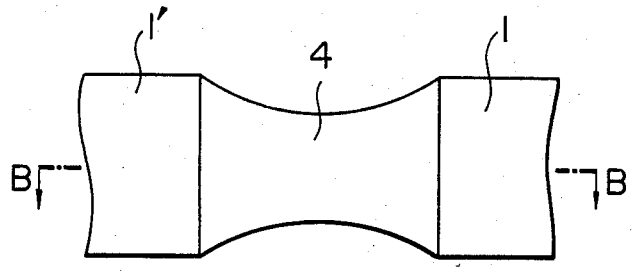
FIG. 2a PRIOR ART
FIGS. 2*a*, 2*b* is a plan view of the heating resistor of another conventional halftone thermal head, and a cross-sectional view taken along line B—B in FIG. 2*a*, respectively.
Figure 2B:
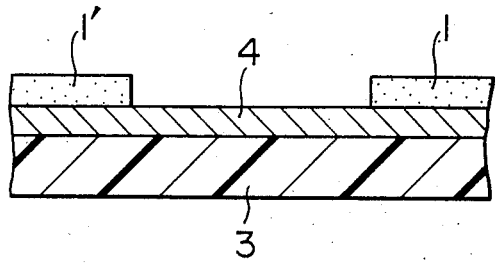
FIG. 2b PRIOR ART
Figure 3A:
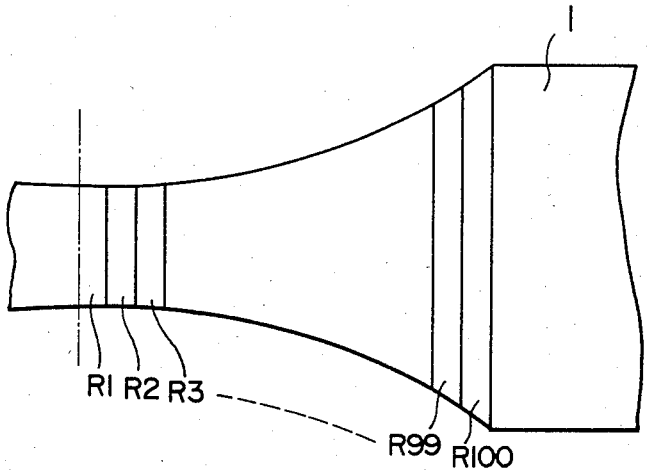
FIG. 3a PRIOR ART
FIGS. 3*a*, 3*b* and 3*c* are respectively a plan view of a half of the resistor of the conventional thermal head shown in FIG. 2*a*, which half of the resistor is divided into 100 parts along the length, a graph of the printing characteristics of the divided parts of the registor, and a graph of other characteristics thereof with respect to applied energy.
Figure 3B:
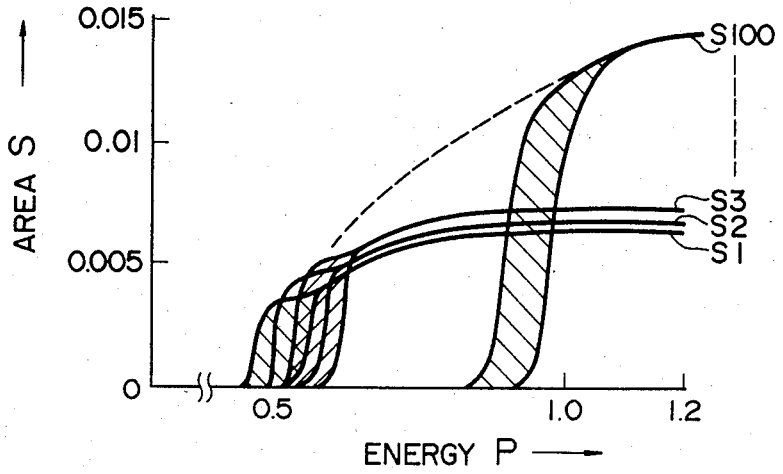
FIG. 3b PRIOR ART
Figure 3C:
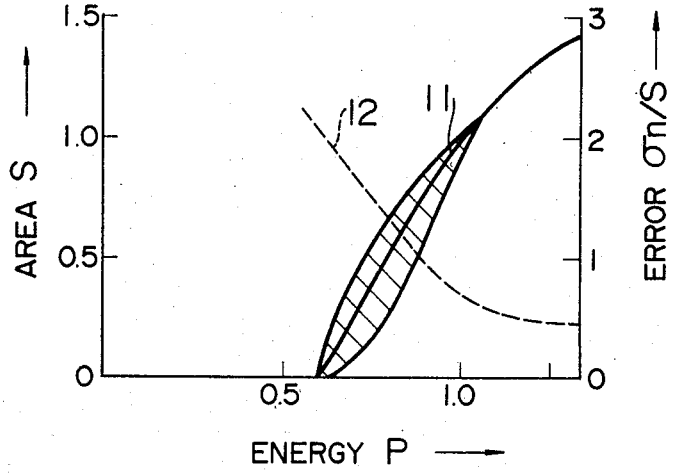
FIG. 3c PRIOR ART
Figure 4:
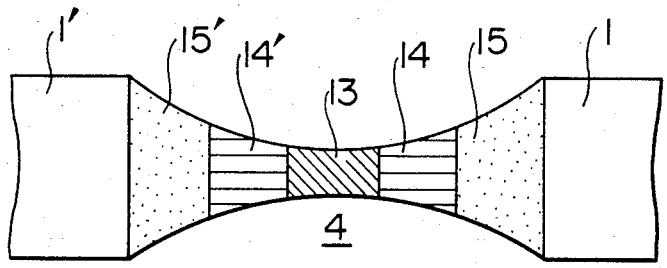
FIG. 4 PRIOR ART
FIG. 4 shows the state in which the heating resistor of the conventional halftone thermal head is supplied with electric power.
Figure 5A:
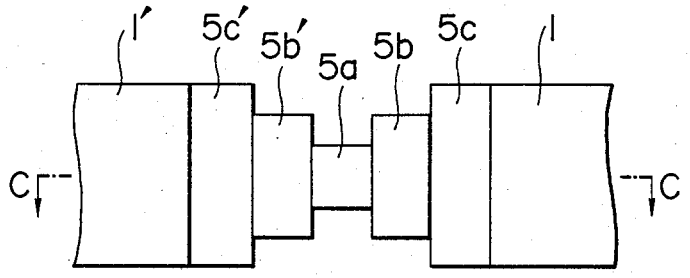
FIGS. 5*a* and 5*b* are a plan view of the heating resistor of an embodiment of a thermal head according to this invention and a cross-sectional view taken along line C—C in FIG. 5*a*, respectively.
Figure 5B:
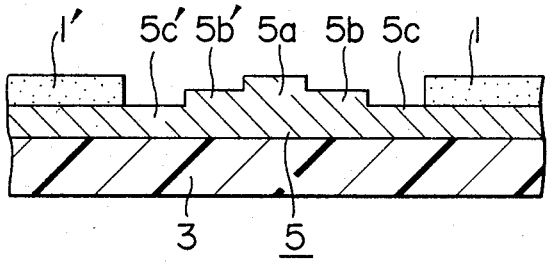

A first embodiment of the invention will be described with reference to FIGS. 5*a* and 5*b*. FIG. 5*a* is a plan view of the heating resistor in the first embodiment of the invention, and FIG. 5*b* is a cross-sectional diagram taken along line C—C in FIG. 5*a*. The basic structure of this thermal head is the same as the conventional binary thermal head, but the shape of the heating resistor 5 is different from the conventional ones. In this embodiment, the heating resistor 5 as shown in FIG. 5*a* is formed of resistive elements 5*a*, 5*b*, 5*b*', 5*c* and 5*c*', or three units of resistive elements 5*a*; 5*b*, 5*b*'; and 5*c*, 5*c*'. The resistive elements in the same unit are of an equal-sized rectangular parallelepiped but those in different units are of unequal-sized rectangular parallelepiped. Although the heating resistor 5 in this embodiment is formed of 5 resistive elements, it may be formed of 6 or above or 4 or below resistive elements, preferably two to about ten. Moreover, the resistive elements may be asymmetrically arranged contrary to the structure shown in FIG. 5*a*.

It is assumed that the length of each of the resistive elements shown in FIGS. 5*a* and 5*b* is measured in the C—C direction, the width thereof in the direction perpendicular to the line C—C and parallel to the substrate and the thickness in the direction perpendicular to the length and width directions. The energy Pr to be applied to each resistive element can be expressed as $$Pr = i^2 \frac{\rho \cdot l \cdot t}{W \cdot d} \text{ (watts} \cdot \text{sec)}$$

where $\rho$ is the resistivity ($\Omega$.cm), l is the length (cm), W is the width (cm), d is the thickness (cm), i is the current (A) and t is the time (sec) during which the current is flowed. The energy, Pu per unit surface area can be expressed as $$Pu = i^2 \frac{\rho \cdot t}{W^2 \cdot d} \text{ (watts} \cdot \text{sec/cm}^2\text{)}$$

The greater the energy Pu, the more heat each resistive element generates per unit surface area, and thus the more easily it prints. Of the factors for determining the energy Pu, the resistivity $\rho$ is dependent on the material of which the resistive elements are made and thus considered to be constant during the processing. Moreover, the current i and time t are common to the respective resistive elements. Therefore, the smaller the characteristic value $W^2d$, the greater the applied energy per unit surface area, and hence the more easily each resistive element prints. In the embodiment of FIG. 5, the value, $W^2d$ of the resistive element 5*c* (5*c*') is larger than the element 5*b* (5*b*') and that of the latter element 5*b* (5*b*') is larger than the element 5*a*. Thus, the resistive element 5*a* can print more easily than the other elements 5*b*(5*b*') and 5*c*(5*c*'). The product W·d, or cross-sectional area of each resistive element is substantially the same and thus the current density is constant in all resistive elements. This follows that the life of the heating resistor can be extended longer than in the conventional halftone head in which the life of the resistive element is inevitably reduced by the current concentration at the center and that the minimum width of each resistive element can be reduced to ½ or below that of the heating resistor of the conventional halftone head.

Figure 6A:
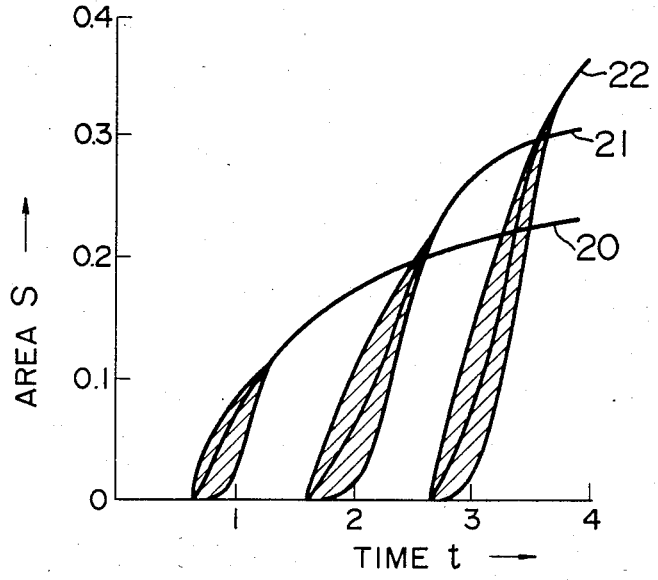
FIGS. 6*a* and 6*b* are a graph of printing characteristics of the heating resistor of the thermal head of the first embodiment of the invention shown in FIG. 5*a*, and a graph of other characteristics with respect to applied energy, of this embodiment, respectively.

FIG. 6*a* shows a graph of experimentally measured characteristic curves of the heating resistor of the first embodiment of the thermal head of the invention. The abscissa indicates the time t proportional to the applied energy and the ordinate shows the printed dot area S. Here, the resistive element 5*a*, 5*b*(5*b*') and 5*c*(5*c*') having area proportion, 0.1, 0.2 and 0.3 are measured on its characteristic and plotted as curves 20, 21 and 22, respectively. From FIG. 6*a* it will be seen that of the curves 20, 21 and 22, the curve 20 corresponding to the resistive element 5*a* has the smallest $W^2d$ value and thus can print most easily and thus can print in the shortest time. Moreover, in any one of the curves 20, 21 and 22, the printed dot area sharply and unstably increases with lapse of time t, until it equals substantially to its surface area, as shown by the hatched area, and then it stably increases with the increase of time, t until the saturation. That is, the resultant characteristic of the stable regions of the characteristic curves 20, 21 and 22 is suitable for presenting the halftone of multigradation. At least, it is necessary that the unstable regions of the adjacent resistive elements are not overlapped.

Figure 6B:
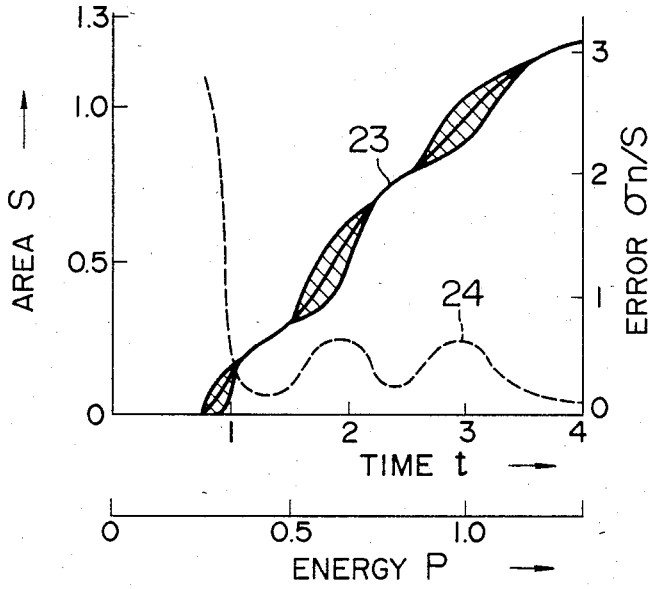

FIG. 6*b* shows the overall characteristic curve of the heating resistor shown in FIGS. 5*a* and 5*b*. The solid line, 23 indicates the average dot area S, and the broken line, 24 shows the standard deviation, $\sigma n/S$ of the dot area. The standard deviation, as indicated by the broken line 24, has maximum at time points 2 and 3, which correspond to the unstable regions at around the printing start points of the resistive elements 5*b* and 5*b*', 5*c* and 5*c*'. The effect of the unstable regions can be removed by properly selecting the shape of each resistive element so that the region printed by the resistive element which is already printing at around the printing start point covers the surface area of the resistive element which starts to print.

In this embodiment, the area ratio of the resistive element 5*a* to the heating resistor 5 is about 0.1, and thus substantially equal to the minimum dot area which can be used for presenting a gradation. In this embodiment, the minimum printed dot area capable of presenting a gradation can be reduced to about 1/6 that of the conventional halftone head. Moreover, it was confirmed that at least 32 gradations can be printed.

Figure 7A:
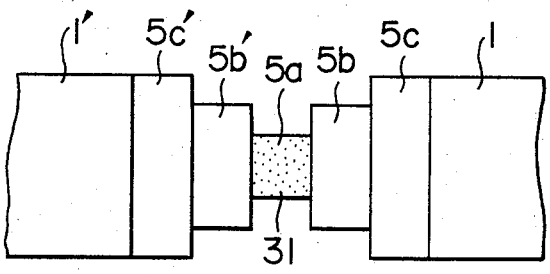
FIGS. 7*a*, 7*b* and 7*c* show the states in which the heating register of the thermal head of the invention as shown in FIG. 5*a* is supplied with electric power.
Figure 7B:
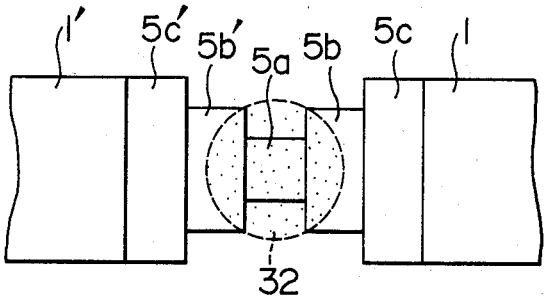
Figure 7C:
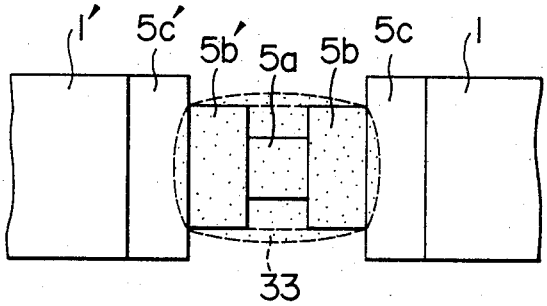

FIGS. 7*a*, 7*b* and 7*c* show the conditions in which the heating resistor of the thermal head of the invention shown in FIG. 5*a* is supplied with power. When the energy applied to the resistor exceeds a critical value, the resistor starts to print a dot 31 substantially equal to the surface area of the resistive element 5*a* (as illustrated in FIG. 7*a*). Then, as the energy applied to the resistor increases, the printed area stably increases as a dot 32 (as shown in FIG. 7*b*). When the energy further increases, all the resistive elements 5*b*, 5*b*' start to print and thus the printed area further increases as a dot 33 (as shown in FIG. 7*c*) in a similar manner as described above.

Figure 8A:
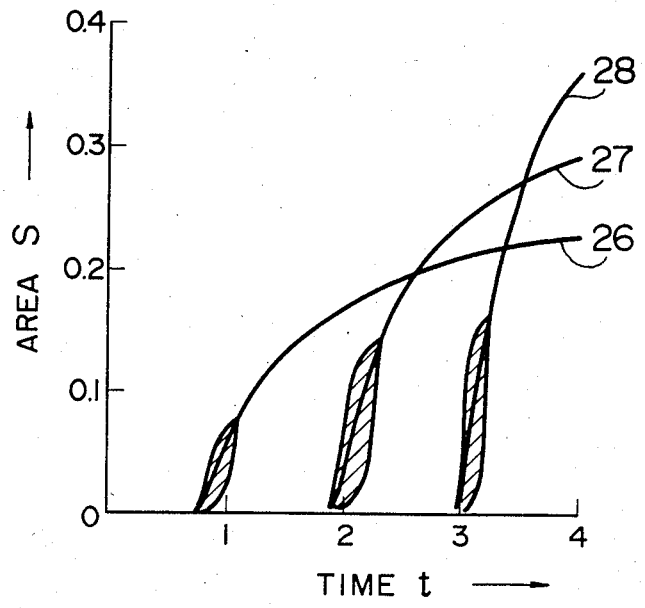
FIGS. 8*a* and 8*b* are a graph of printing characteristics at the states of FIG. 7*c*, of the heating resistor of the thermal head of the invention shown in FIG. 5*a* and a graph of other characteristics with respect to applied energy, of this embodiment, respectively.
Figure 8B:
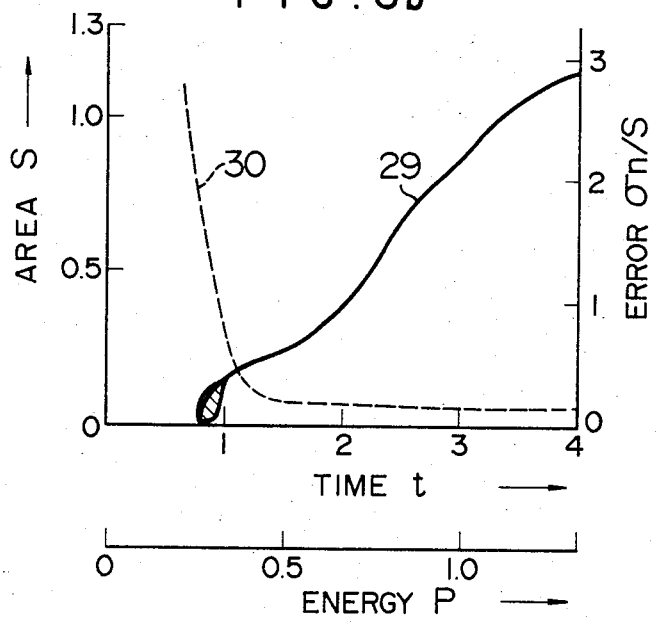

As in FIGS. 7*a*, 7*b* and 7*c*, when the unstable regions of the resistive elements 5*a* and 5*b*, 5*b*' are not overlapped, and when the dot printed by the resistive element 5*a* includes substantially all the regions of the resistive elements 5*b*, 5*b*' at the condition that the resistive elements 5*b*, 5*b*' start to print (in FIG. 8*a*, at relative time 2), the resistive elements 5*b*, 5*b*' cause no unstable regions. Therefore, as shown in FIG. 8*b* by the applied energy vs. printed dot area characteristic 29 and the standard deviation characteristic 30, stable halftone recording can be realized except the initial unstable region by the resistive element 5*a*. Although the effect of the unstable region by the resistive element 5*a* appears as it is upon printing, the resistive element 5*a* has the smallest area and thus has almost no effect.

Figure 9A:
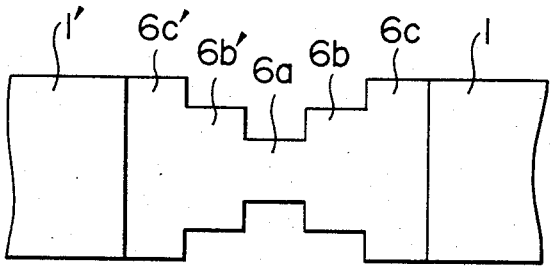
FIGS. 9*a* and 9*b* are a plan view of the heating resistor of a second embodiment of a thermal head of the invention, and a front view thereof, respectively.
Figure 9B:
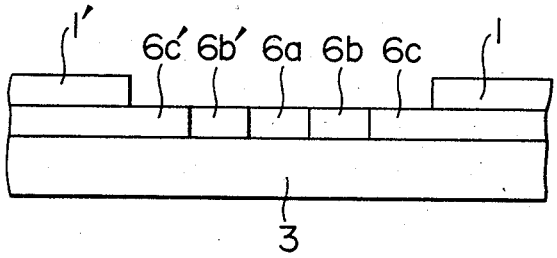

FIG. 9 shows the heating resistor in a second embodiment of this invention. FIG. 9*a* is a plan view thereof and FIG. 9*b* is a front view thereof. The basic structure is substantially the same as that of the embodiment of FIG. 5, but the structure is different in that the resistive elements 6a, 6b, 6b', 6c, and 6c' have a constant thickness. Since the current density in the resistive element 6a of the minimum width is the largest because the thickness is constant over the whole resistor, the minimum dot has substantially the same area of the resistive element 6a. Here, such small dot as in the embodiment of FIG. 5 cannot be achieved, but stable halftone presenting characteristic can be obtained. Moreover, since the resistor is formed of one resistive layer, the resistor can be produced with higher precision than the multilayer resistor and the process for the production can be simplified.

Figure 10:
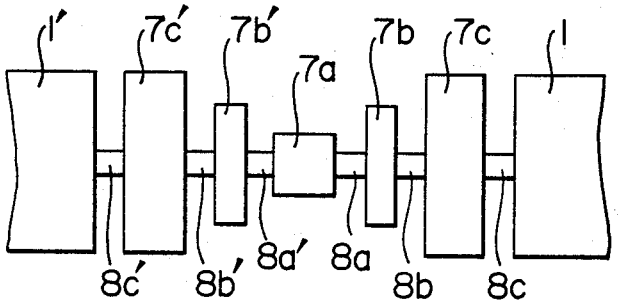
FIG. 10 is a plan view of the heating resistor of a third embodiment of a thermal head of the invention.

FIG. 10 is a plan view of the heating resistor in a third embodiment of the invention. In this embodiment, resistive elements 7a, 7b, 7b', 7c and 7c' are separated and the adjacent ones thereof are connected by conductors 8a, 8a', 8b, 8b', 8c and 8c'. The resistive elements may have constant thickness or different thickness. In this embodiment, the area of each resistive element is smaller than in the previously mentioned embodiments because the conductors are formed between the electrodes, provided that the distance between the electrodes is constant. Therefore, the standard deviation of the dot area in the unstable region of the printing characteristic can be decreased and hence the halftone can be stably presented.

Figure 11A:
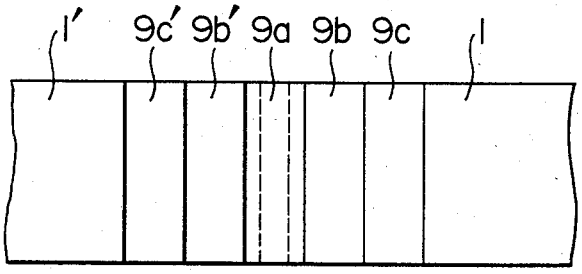
FIGS. 11*a* and 11*b* are a plan view of the heating resistor of a fourth embodiment of a thermal head of the invention, and a front view thereof, respectively.
Figure 11B:
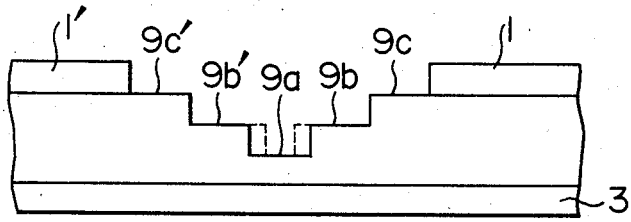

FIG. 11 shows the heating resistor in a fourth embodiment of this invention. FIG. 11a is a plan view thereof, and FIG. 11b is a front view thereof. In this embodiment, the halftone presentation can be realized by using resistive elements 9a, 9b(9b') and 9c(9c') of only different thickness. In order to minimize the influence of the unstable region of the resistive element 9a to which the largest amount of energy per unit area is applied, on the printing, it is necessary to make the length of the resistive element 9a shorter as illustrated by broken lines in FIGS. 11a and 11b.

Figure 12:
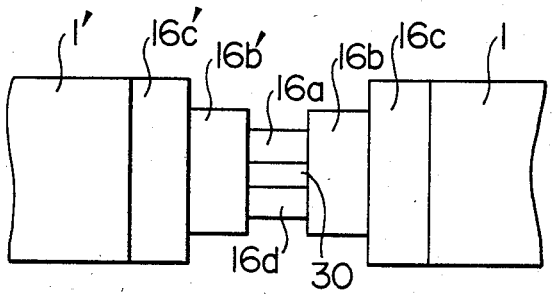
FIGS. 12 and 13 are respectively plan views of the heating resistors of fifth and sixth embodiments of a thermal head of the invention.
Figure 13:
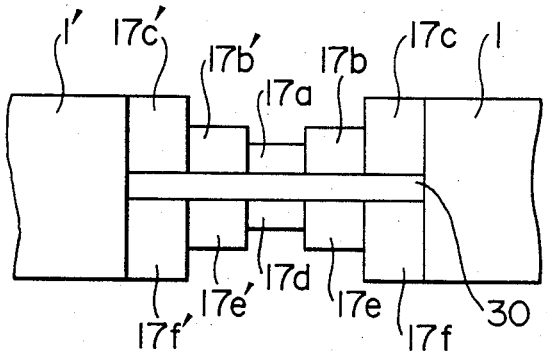

FIGS. 12 and 13 show the heating resistors in fifth and sixth embodiments of the invention. In these embodiments, at least one resistive element is divided in the width direction into a plurality of substantially equal rectangular parallelepipeds spaced by a distance 30. Since this structure can reduce the excessively stored heat at the center of each resistive element, the heat distribution in each resistive element can be made uniform. Therefore, it is possible to extend the life of the heating resistor which depends on the highest temperature of the heating resistor.

In FIG. 12, the most-heat generating resistive element is divided into two parts 16a and 16d with the gap 30 therebetween. In FIG. 13, each of all the resistive elements is divided into two parts 17a, 17b, 17b', 17c, 17c' and 17d, 17e, 17e', 17f, 17f'.

While in the embodiments of the invention shown in FIGS. 5, 9, 10, 11 and 12, a group of resistive elements corresponding to one dot are formed between the opposite electrodes 1,1', those corresponding to a plurality of dots may be connected in series between the opposite electrodes.

Figure 14:
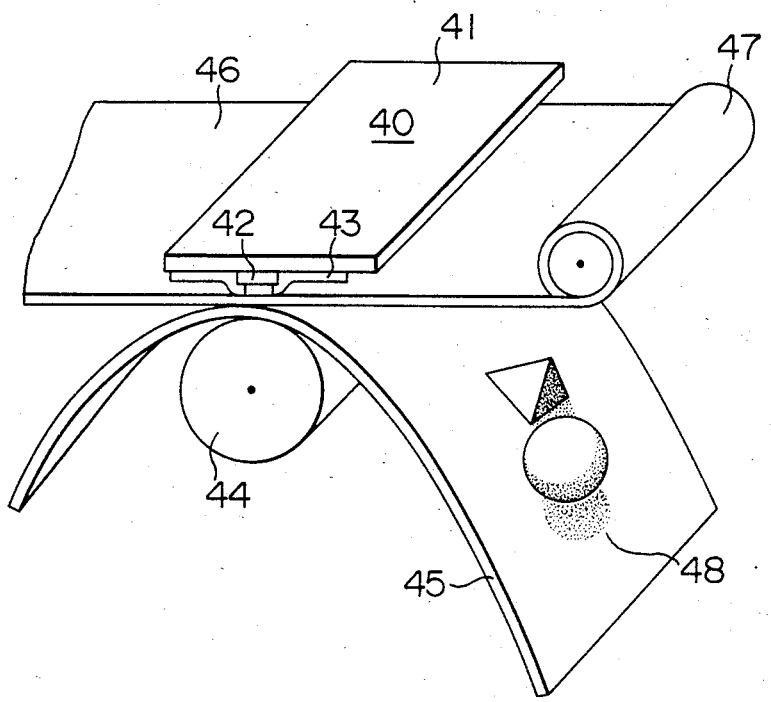
FIG. 14 is a perspective view of a main portion of a gradational image reproducing apparatus using a thermal head of the invention.

FIG. 14 shows an example of the main portion of the apparatus for reproducing a halftone image by using a thermal head according to this invention. A thermal head 40 of the invention is produced by forming on a substrate 41 an array of heating resistors 42 each having a plurality of heating resistive elements and pairs of opposite electrode conductors which are connected to the ends of each heating resistor so as to transmit electric power thereto. Since this apparatus is of the thermal transfer type, transfer sheet 46 with its rear side coated with ink and ordinary paper 45 to which an image is to be transferred are placed in intimate contact with each other and held between the thermal head 40 and a platen roller 44. An electric power corresponding to an image signal is supplied to each heating resistor, and a used-transfer sheet taking-up roller 47 and the platen roller 44 are rotated in synchronism with each other so that a halftone image 48 is reproduced on the transferred paper 45.

According to a thermal head of this invention, the minimum dot area can be greatly reduced, and the relation between the applied energy to the heating resistor and the dot area is stablized so that the halftone of multigradation can be presented particularly in a low-optical-density region.

We claim:

1. A thermal head comprising:

at least a pair of opposite electrodes; and a heating resistor connected between said pair of electrodes;

said heating resistor being formed of a plurality of resistive units, each of said resistive units including at least one resistive element having a substantially rectangular parallelepiped shape, said at least one resistive element of said resistive units being electrically connected in series and formed in such a size that when a unit current flows in said heating resistor, applied energy per unit surface area of a resistive element of each resistive unit is different from the applied energy per unit surface area of a resistive element of the other resistive units.

2. A thermal head according to claim 1, wherein said resistive elements of said resistive units have a characteristic such that the smaller a width of said resistive elements in a direction perpendicular to a direction in which said resistive units are connected in series, the greater the applied energy per unit surface area of said resistive elements when a unit current flows in said heating resistor.

3. A thermal head according to claim 1, wherein said resistive elements of said resistive units are disposed so that the smaller the applied energy per unit surface area of a respective resistive element when a unit current flows in the heating resistor, the more distant said resistive element is from a resistive element having the maximum applied energy per unit surface area when a unit current flows in the heating resistor.

4. A thermal head according to claim 3, wherein said resistive elements of said resistive units are disposed such that the applied energy necessary for said resistive element of each resistive unit to start stable printing is smaller than an unstable printing start energy to be applied to a resistive element of an adjacent resistive unit which has smaller applied energy per unit surface area when a unit current flows in the heating resistor.

5. A thermal head according to claim 4, wherein said resistive elements of said resistive units are disposed such that the surface are of said resistive element of a resistive unit is substantially covered by an area printed by a resistive element of an adjacent resistive unit which has larger applied energy per unit surface area when a unit current flows in the heating resistor when the same energy as the applied energy necessary for said resistive element to be covered to start stable printing is applied to the resistive element of said adjacent resistive unit.

6. A thermal head according to claim 3, wherein the applied energy necessary for said resistive element of each resistive unit to start said stable printing corresponds to the applied energy necessary for causing a printed area substantially equal to the surface area of said resistive element.

7. A thermal head according to claim 4, wherein the applied energy necessary for said resistive element of each resistive unit to start said stable printing corresponds to the applied energy necessary for causing a printed area substantially equal to the surface area of said resistive element.

8. A thermal head according to claim 1, wherein said resistive elements are electrically connected in series through conductors which are interposed therebetween.

9. A thermal head according to claim 1, wherein said resistive element of at least one resistive unit is formed of spaced parallel resistive parts.

10. A thermal head according to claim 9, wherein said parallel parts resistive element is supplied with the largest amount of applied energy per unit surface area when a unit current flows in said heating resistor.

11. A thermal head comprising:

at least a pair of opposite electrodes; and a heating resistor connected between said opposite electrodes;

said heating resistor including a plurality of substantially rectangular parallelepiped resistive elements electrically connected in series and which are so arranged so as to be symmetrical with respect to a center resistive element having a maximum applied energy per unit surface area when a unit current flows in the heating resistor, and wherein the more distant a resistive element is from the center resistive element, the smaller the applied energy per unit surface area of the more distant resistive element when a unit current flows in the heating resistor.

* * * * *